United States Patent [19]

Blair et al.

[11] 4,388,153

[45] Jun. 14, 1983

[54] COKE SPILLAGE REMOVAL DEVICE

[75] Inventors: Gilbert Blair, Coraopolis, Pa.; Martin C. Dusel, Indianapolis, Ind.

[73] Assignee: Dravo Corporation, Pittsburgh, Pa.

[21] Appl. No.: 323,182

[22] Filed: Nov. 20, 1981

[51] Int. Cl.[3] ..... C10B 25/14; C10B 33/14; C10B 45/00

[52] U.S. Cl. ..... 202/248; 202/262; 414/212

[58] Field of Search ..... 202/239, 248, 262, 270; 414/152, 155, 212

[56] References Cited

U.S. PATENT DOCUMENTS

| | | | |
|---|---|---|---|
| 2,310,924 | 2/1943 | Becker | 202/262 |
| 3,436,316 | 4/1969 | Lorrek | 202/262 |
| 4,003,802 | 1/1977 | Pries | 202/248 |
| 4,026,768 | 5/1977 | Bahnsch et al. | 202/248 |
| 4,053,068 | 10/1977 | Gidick | 414/212 |
| 4,153,515 | 5/1979 | Gregor et al. | 202/248 |
| 4,166,007 | 8/1979 | Becker | 202/270 |
| 4,248,562 | 2/1981 | Tsuzuki et al. | 414/212 |
| 4,270,982 | 6/1981 | Lakin et al. | 202/262 |
| 4,276,121 | 6/1981 | Rogers | 414/212 |
| 4,276,123 | 6/1981 | Emery | 202/248 |

FOREIGN PATENT DOCUMENTS

| | | | |
|---|---|---|---|
| 1559324 | 1/1980 | United Kingdom | 202/262 |

*Primary Examiner*—Bradley Garris

*Attorney, Agent, or Firm*—Parmelee, Miller, Welsh & Kratz

[57] ABSTRACT

A coke oven battery servicing apparatus includes a coke catching and collecting bucket movable from a first position adjacent the oven to a second position clear of the oven and a coke guide cage having an opening therein which is complementary to the bucket. When in the first position the bucket collects coke spillage during oven door extraction and door jamb cleaning. When the coke guide is positioned for pushing, the bucket is moved into a third position in which the bucket is removably inserted into the aforementioned opening to become integral with the coke guide cage. The collected coke spillage is then pushed together with the coke from the oven through the guide means for disposal in a quenching receptacle or car.

13 Claims, 9 Drawing Figures

COKE SPILLAGE REMOVAL DEVICE

BACKGROUND OF THE INVENTION

1. Field of the Invention

The invention is related to coke oven battery servicing equipment in general and, more particularly, it is directed to equipment for catching and collecting hot coke spilled from the oven when the doors are removed and a coke guide for conveying the collected spillage and the coke pushed from the oven to a quenching receptacle.

2. Description of the Prior Art

A coke oven is a long, narrow chamber which is accessed on each end through a removable door. The ovens are generally arranged side by side in an integral structure which forms a coke oven battery. This battery is serviced on both sides by cars which travel along tracks parallel to the battery. On one side, referred to as the "pusher side", the car has pusher equipment which urges the coke from the oven. On the other side, the "coke side", the car has a coke guide which spans the coke side bench and guides the coke from the oven into a hot coke quenching receptacle. Both cars are provided with door extractor, door cleaner and door jamb cleaning equipment. The door extractor unlocks, removes and then reinstalls the oven door. The door cleaner removes coke and breeze from the door's gas channels. The door jamb cleaner removes coke and breeze from the oven door jamb just prior to the reinstallation of the oven door.

On coke oven batteries, there is a spillage of hot coke from the oven when the doors are removed prior to the oven being pushed. The spillage usually lands on the battery bench causing damage to the machine rails as the coke is ground up by the rolling wheels of the servicing car, and of course creating a safety hazard for any personnel on the bench.

On older batteries, it is commonplace for bench personnel to manually remove coke spillage by shoveling it over the side of the bench or into the quenching receptacle. On current batteries, the typical method is to catch the coke spillage as the door is removed, and by a system of drag conveyor chains, convey the coke through the machine for deposit in the quenching receptacle. Another coke spillage removal method commonly used in West Germany is a drag chain conveyor operating along the bench in front of the ovens. The spillage is conveyed to a hopper at the end of the bench for disposal. The bench type drag chain runs continuously at a very slow speed during the pushing operation.

Other solutions to the problem of catching coke spillage have been suggested. For example, U.S. Pat. No. 4,166,007 discloses a device for catching coke oven spillage on the pusher side during door removal and during withdrawl of the pusher ram. The device moves on separate rails of its own, independent of the pusher machine. The device is pivoted so that it can dump the spillage back into the oven. U.S. Pat. No. 2,310,924 discloses a receptacle mounted under the coke guide for receiving spillage during pushing. The collected coke is periodically removed to the quencher car. This receptacle is carried by the coke guide and since the door is removed by a door remover displaced laterally of the ovens on the coke guide car, there is nothing to catch spillage during door removal.

SUMMARY OF THE INVENTION

This invention is a coke oven battery servicing apparatus for catching and collecting coke discharged from the oven during door removal and conveying the collected coke spillage together with the coke pushed from the oven to a quenching receptacle. This is commonly called a "one spot" operation. The servicing apparatus of this invention is mounted on a coke side servicing car disposed between the oven battery and the quenching receptacle which is typically a hopper type railroad car. The apparatus itself includes a coke guide which has a planar floor member having an opening therein proximate the end of the coke guide adjacent the oven battery during the pushing operation. The coke guide is mounted on the servicing car for selected movement from at least a first position in which the coke guide is spaced from the oven face for door removal to a position in which the pushing operation can be effected.

The apparatus of this invention also includes a coke spillage catching and collecting bucket which is "U"-shaped with a generally planar bottom member. The planar bottom member is complementary in size to the opening in the floor member of the coke guide and is removably insertable into the aforementioned opening to form therewith a continuous coke guide floor. The bucket is mounted on the servicing car for selective movement from at least a position in which the bucket is disposed below and adjacent the coke oven selected for servicing during door removal to catch and collect discharged coke, to a position in which the bucket is removably inserted into the opening in the coke guide floor. The open portions of the "U"-shaped bucket are in axial alignment with the longitudinal axis of the coke guide so that coke spillage in the bucket is pushed into the quenching car along with the coke pushed from the oven.

Upon completion of the pushing operation, the bucket is withdrawn from the coke guide and repositioned below and adjcent the coke oven being serviced in order to catch any breeze generated by door jamb cleaning procedures. The collected breeze is then disposed of during the pushing of the next oven serviced.

It is an object of this invention to provide a coke oven battery servicing apparatus for the coke side of the oven which efficiently catches, collects and conveys coke oven spillage caused during door removal operations to a coke quenching receptacle.

It is a further object of this invention to provide an apparatus which catches and collects breeze during door jamb cleaning for efficient disposal with the coke spillage.

It is an additional object of this invention to provide an oven servicing apparatus which can be successfully employed on coke side servicing cars of various designs and configurations.

It is a still further object of this invention to minimize the exposure of hot coke spillage to the atmosphere, thus reducing the smoke and fume polution around the coke oven battery.

BRIEF DESCRIPTION OF THE DRAWINGS

The above as well as other features and advantages of this invention will become apparent through consideration of the detailed description in connection with the accompanying drawings in which.

DETAILED DESCRIPTION OF THE INVENTION

Figure 1A:
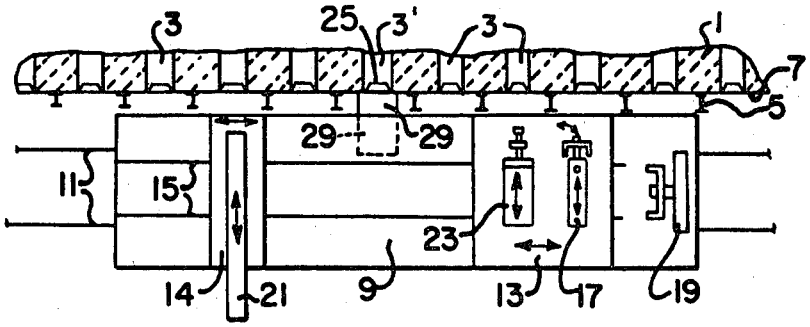
FIGS. 1*a* through 1*d* schematically illustrate in plan view, a coke side servicing car incorporating the features of this invention, servicing a selected coke oven in a coke oven battery.

Throughout the detailed description of the instant invention, the preferred embodiment will show the coke spillage collection bucket and coke guide system in connection with a coke servicing car on which the various servicing devices are mounted for longitudinal movement on a single spot type servicing car. This is done for illustrative purposes only, because as should be obvious to those skilled in the art, the instant apparatus can be readily employed with coke side servicing cars of various designs. Examples of such coke side servicing cars include the single spot car disclosed in U.S. Pat. No. 4,270,982 and the turntable-like single spot car disclosed in U.S. Pat. No. 3,436,316.

Turning now to FIGS. 1*a* through 1*d*, the various servicing steps involved in the pushing operation on the coke side of a coke oven battery are schematically illustrated by a coke side servicing car having thereon the apparatus of this invention. The coke oven battery 1 consists of a plurality of long, narrow coke ovens 3 arranged side by side. A plurality of buckstays 5 protrude from the oven face 7 and are part of the support structure thereof. The coke side servicing car 9 is mounted on wheels for movement along its longitudinal axis in a direction substantially parallel to the oven face 7 along a pair of rails 11. First and second support carriages 13 and 14 respectively, are each mounted on wheels for independent movement along their longitudinal axis along a common pair of rails 15 secured to the securing car 9. The rails 15 are substantially parallel with the rails 11. An oven door extractor 17 and an oven door jamb cleaner 23 are mounted for independent reciprocal movement on support carriage 13 and a coke guide cage is mounted for reciprocal movement on support carriage 14. An oven door cleaner is mounted on the servicing car 9 in a position which facilitates the presentation of the door thereto. As will be hereinafter fully described, the 'U'-shaped bucket of this invention indicated generally at 29 is mounted for vertical movement in a bucket support assembly. The bracket is pivotally mounted on the side of the servicing car 9 facing the oven battery 1 for reciprocal movement from a stowed position in which the bracket is clear of the ovens buckstays 5 to a servicing position in which the bracket and the bucket supported therein are adjacent the oven selected for servicing.

Figure 1B:
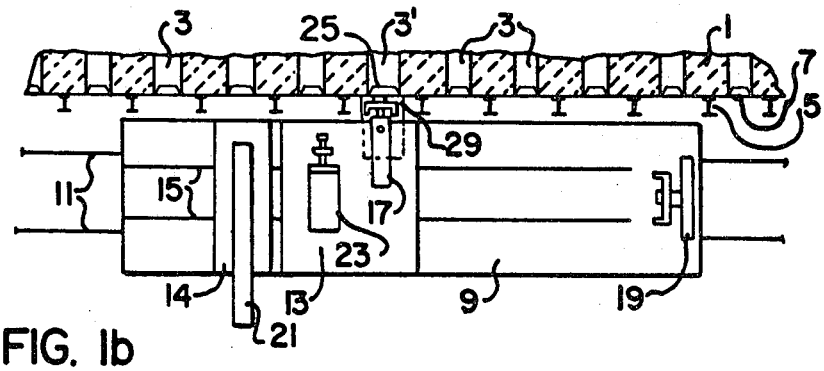

During the pushing operation, the coke is urged from the oven by a pusher arm inserted into and through the oven toward the coke side (not illustrated). In preparation for the pushing of a selected coke oven 3', the coke side servicing car is parked or spotted in front of the selected oven 3'. In spotting the servicing car 9, the 'U'-shaped bucket 29 is aligned with the selected oven 3' and pivoted into position from its stowed position, shown in phantom, to its servicing position. The support bracket assembly of the bucket 29 will remain in the servicing position throughout the pushing operation. The carriage is then positioned through travel along rails 15 in order to align the door extractor 17 with the longitudinal axis of the selected oven 3'. The door extractor 17 is mounted for pivotal movement, reciprocal movement, toward and away from the oven face, and longitudinal movement parallel to oven face 7. The door extractor 17 engages and unlatches the oven door 25 as shown in FIG. 1*b*, and then moves back from the oven face, along the longitudinal axis of the selected oven 3', between the buckstays 5 on either side of the selected oven 3'. During the oven door removal process, the hot coke spillage from the oven is caught and collected in the 'U'-shaped bucket.

Figure 1C:
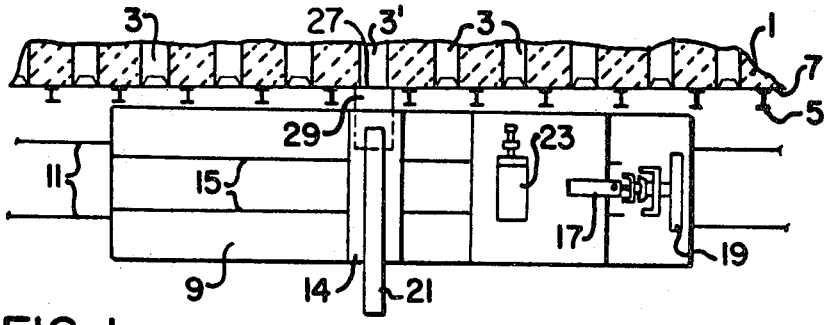

Once the door extractor 17 and the oven door 25 are clear of the buckstays 5, the support carriage 13 travels along tracks 15 toward door cleaner 19. The door extractor pivots into alignment with the door cleaner 19 and engages the oven door 25 therewith. The support carriage 14 then moves the coke guide cage 21 into axial alignment with the selected oven 3' as seen in FIG. 1*c*. The coke guide, which is also mounted for reciprocal movement toward and away from the oven face 7, is positioned to abut the open selected oven 3'. As will be described in more detail below, the coke guide 21 is provided with an opening in its floor which is complementary to the 'U'-shaped bucket. The bucket is lifted into the guide and becomes an integral part thereof during the pushing operation. When the bucket is inserted into the coke guide, the spillage is carried with it, whereupon the coke is pushed from the oven through the coke guide together with the collected spillage and into a quenching receptacle (not shown) adjacent the far side of the car.

Figure 1D:
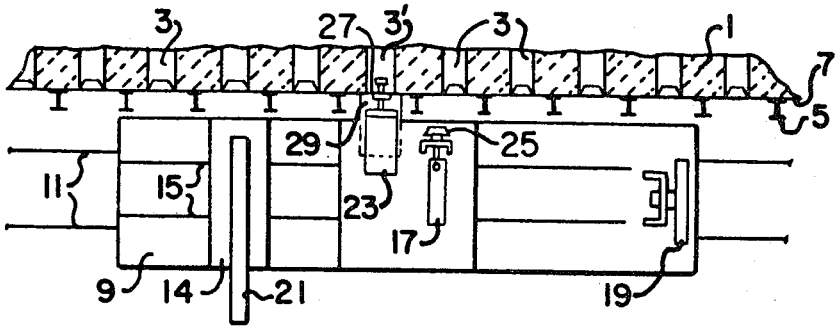

After the pushing is completed the 'U' bucket is lowered, from the guide cage and the guide cage 21 is withdrawn from the oven. The second carriage 14 removes the coke guide cage 21 to the left hand side of the car 9. The first carriage 13 is repositioned on the car 9 to align with the now empty selected coke oven 3' as shown in FIG. 1*d*. The door jamb cleaner 23 which is laterally movable relative to the servicing car 9 engages the oven door jamb 27 and removes coke breeze on and about the door jamb 27 so that a good seal is established when the now clean, coke oven door 25 is returned to the oven 3'. The 'U'-shaped bucket, in its lowered position catches and collects breeze loosed by the jamb cleaner. The breeze is retained in the bucket for disposal during the pushing of the next oven. After jamb cleaning is effected, the door jamb cleaner 23 is withdrawn from the oven 3', the door extractor 17 is pivoted into a position parallel with the longitudinal axis of the ovens 3 and the carriage 13 is repositioned so that the door extractor 17 is aligned with the longitudinal axis of the selected oven. The coke oven servicing equipment is again positioned as it was in the initial door removing operation illustrated in FIG. 1*b*. The oven door is reinserted and locked into place and the door extractor withdrawn from the oven. Finally, the 'U'-shaped bucket 29 is withdrawn from the oven face by the support brackets which pivot into the stowed position, shown in phantom in FIG. 1*a*. The servicing car 9, can now be moved from the selected oven 3' to the next oven to be serviced. It must be recognized that the particular arrangement of coke oven servicing equipment utilized as well as the specific type of servicing car on which this equipment is mounted are subject to a variety of changes and configurations without departing from the spirit and scope of the instant invention as described below.

Figure 2:
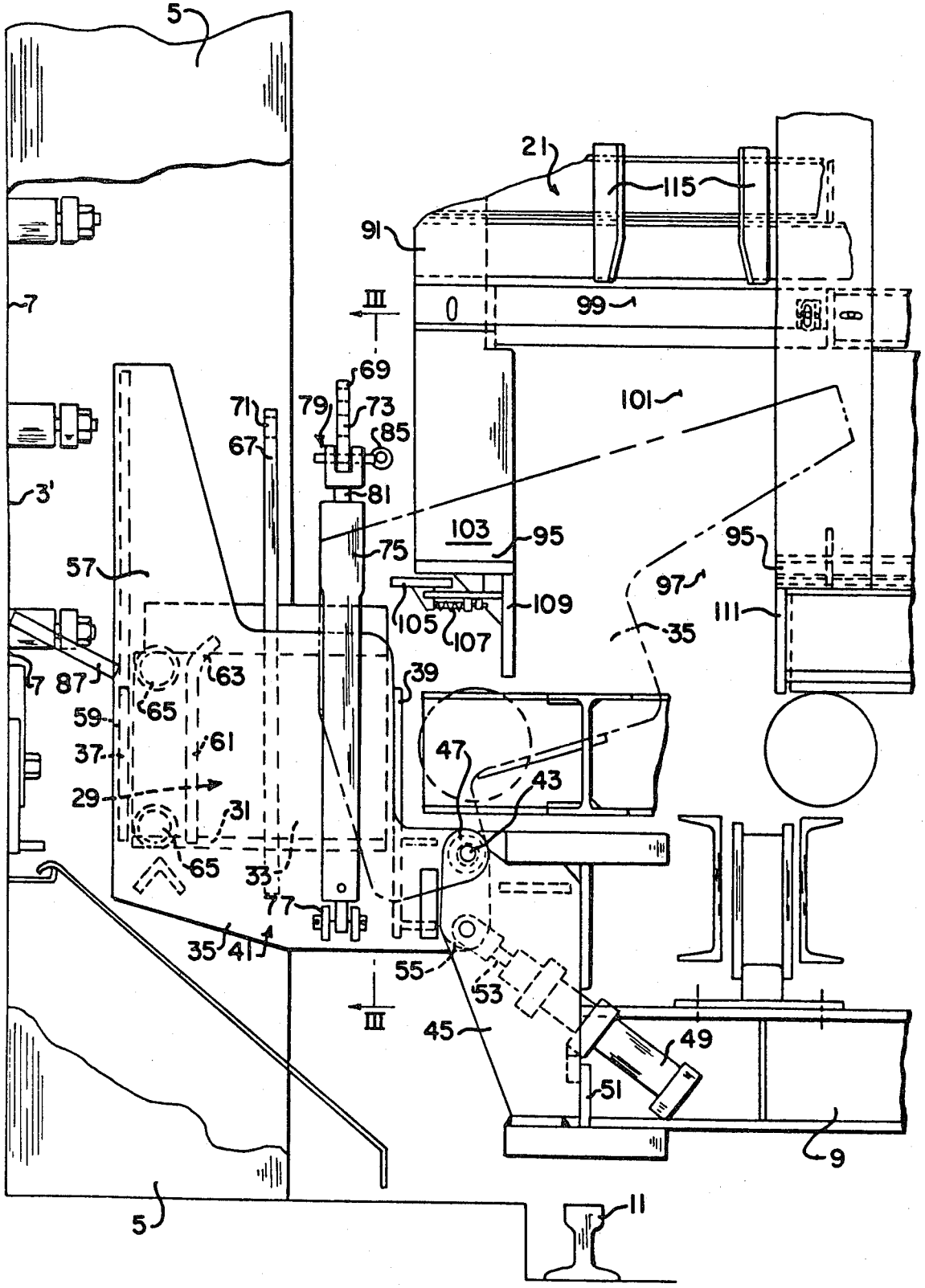
FIG. 2 is a side elevation of the coke oven servicing apparatus of this invention positioned to catch and collect coke spillage, with portions of the servicing car and coke oven battery cut away and with the stowed position of the apparatus shown in phantom.
Figure 3:
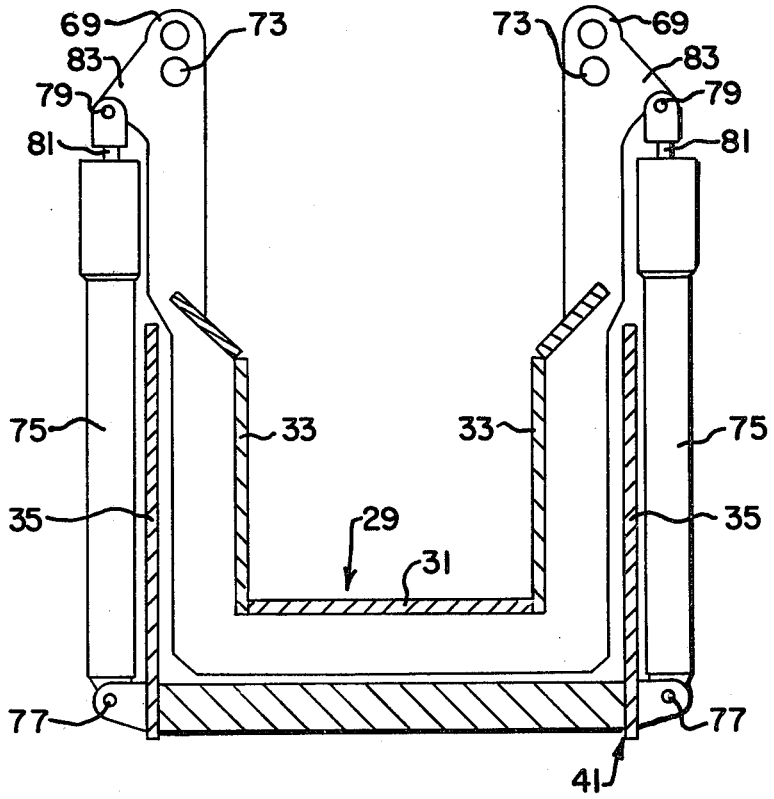
FIG. 3 is a section view through the U-shaped, coke spillage collection bucket and bucket support bracket of this invention along lines III—III of FIG. 2.
Figure 4:
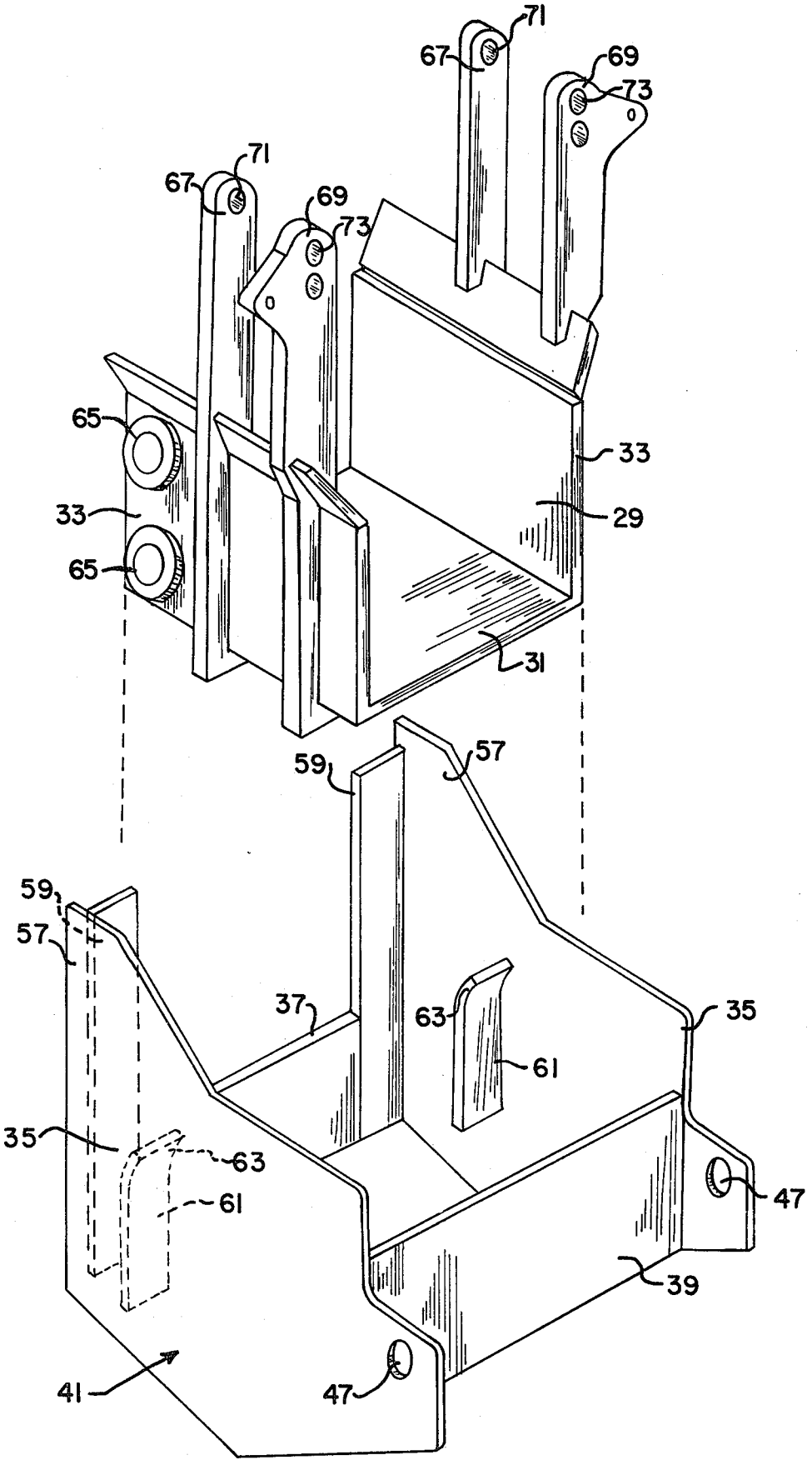
FIG. 4 is an exploded isometric view of the preferred embodiment of the spillage bucket and bucket support assembly of this invention.

Turning now to FIGS. 2, 3 and 4 the manner in which the instant invention addresses the problems of coke and breeze spillage will be detailed. The servicing car 9 is spotted at a selected coke oven 3' for the removal of the oven door which door is not illustrated in FIG. 2. A generally 'U'-shaped spillage bucket 29 with open opposed ends consisting of a planar bottom member 31, and two upwardly extending side members 33, is mounted on the servicing car 9 for reciprocal movement toward and away from the oven battery and reciprocal, vertical movement relative to the coke oven. Because the spillage bucket 29 is mounted on the servicing car 9, care must be taken to spot the servicing car 9 so that the spillage bucket 29 is centered on the longitudinal axis of the particular oven being serviced. Once the servicing car is to spotted, it will not be moved until the entire pushing operation is completed for that particular oven. The several oven servicing devices will be repositioned by means of the carriages 13 and 14 mounted on the servicing car 9.

The spillage bucket 29 is supported for vertical movement relative to the oven face and reciprocal movement toward and away from the oven face by a bucket support assembly 41 which includes a pair of bucket support members 35 held in a fixed relation relative to each other by a forward vertical shield 37 and a rear vertical shield 29. The bucket support assembly 41 is mounted for pivotal movement along a horizontal axis 43 toward and away from the oven battery face 7 for positioning in a servicing position and a stowed position which is shown in phantom. The stowed position provides at least the minimum clearance necessary for the spillage bucket support assembly 41 to be free from possible interference with the protruding buckstays 5 as the servicing car 9 moves from one oven to the next. A pair of frame members 45 are affixed to the side of the servicing car 9 facing the oven battery and provide pivotal support for the assembly 41 by rotary connection 47. The frame members 45 are straddled by the assembly 41 and an assembly tilting device, such as the pair of hydraulic cylinders 49 (only one illustrated) are positioned therebetween to effect the pivotal movement of the bucket support assembly 41. Each cylinder 49 is mounted on the frame work 51 of the servicing car 9 and the cylinder's piston rod 53 is pivotally connected to the spillage bucket support members proximate the horizontal axis 43 through crank arm 55. While a pair of hydraulic cylinders has been shown, it is possible to utilize various other systems to effect movement such as ropes and pulleys or rack and pinion drive.

The 'U'-shaped bucket 29 is removably mounted in the support assembly 41 for vertical movement relative thereto. When in a first or down position as shown in FIGS. 2 and 3, the front vertical shield 37 and the rear, vertical shield 39 function as closure plates for the open ends of the 'U'-shaped bucket 29. The inner faces 57 of the support members 35 are each provided with a set of guide rails consisting of an elongated rail 59 near the outside edge of the support member 35 and a shorter rail 61 spaced therefrom and curved slightly toward the servicing car 9 as at 63. The 'U'-shaped bucket's side members 33 are provided with a pair of guide rollers 65 which travel between and along the rails 59 and 61. The curved portion 63 of rail 61 facilitates the engagement of the rollers 65 with the rail 61. Additionally, the side members 33 each include a pair of upwardly extending parallel arms 67 and 69. The arms, as illustrated herein, are an integral part of the support structure which extends down and around the bottom of the U-shaped bucket 29. The forwardly disposed arm 67, that is to say the arm nearest the oven side of the bucket has at least one bore 71 therethrough and the rearwardly disposed arm has at least one bore 73 therethrough axially aligned with bore 71. The purpose of which bores will be explained hereinafter. One of the arms 67 or 69, arm 69 herein, is in communication with means for effecting the vertical movement of the bucket within the support assembly 41. While various means may be employed, it is preferred that a hydraulic cylinder 75 be positioned between the outside wall of the support member 35 as at 77 and the arm 69 and 79. The piston 81 of the cylinder 75 is removably secured to a bracket 83 extending from arm 69 by a self locking pin 85. The actuation of the hydraulic cylinder will lift the 'U'-shaped bucket 29 vertically, as guide rollers 65 travel along the rails 59 and 61, into a second or raised position which will be more fully explained below.

The side elevational view of FIG. 2 shows the 'U'-shaped bucket in the down position and the bucket support assembly pivoted into a position between the buckstays of the oven so that the bucket is adjacent and below the oven about to be serviced. In this position, the oven door is readily accessable to the door extractor and the bucket can catch and collect any hot coke spillage which occurs during the unlatching and withdrawal of the oven door. An upper deflector plate 87 may be placed to extend from the oven face 7 below the oven door jamb and to angle downwardly toward the bucket 29 in order to direct coke spillage into the bucket. Once the spillage of hot coke terminates and the door extractor equipment is clear of the oven, the coke guide means of this invention can be moved into position.

The present coke guide cage means, generally indicated by the reference character 21, has a first end 91 and a second end (not illustrated) and is an elongated, open-ended box like structure with approximately the same inside dimensions as a coke oven, that extends laterally across the width of servicing car 9. A planar floor member 95 extending from the first end 91 to the second end of the coke guide 21 has an opening as at 97 therein proximate the first end 91. The opening 97 is complementary to the planar bottom member 31 of the 'U'-shaped bucket 29. Moreover, both the right and left side planar members 99 of the guide have openings as at 101 therein which are complementary to the two side members 33 of the 'U'-shaped bucket 29. The portion of the coke guide cage 21 at the first end 91 thereof forward of the openings 97 and 101 defines a stirrup 103 which generally abuts the oven face and surrounds the open door jamb area of the oven to be pushed. The stirrup 103 is provided with a spring loaded closure plate 105 which is forwardly biased by spring means 107 in order to abut the oven face 7 when the guide is moved against the oven. Typically the coke guide cage 21 is mounted for the aforedescribed movement in a coke guide carriage. Once the coke guide 21 is moved into this position as illustrated in FIG. 4, the 'U'-shaped bucket 29 is moved into the second or raised position.

Since the 'U'-shaped bucket 29 is at least partially filled with coke spillage, portions of the coke guide cooperate with the bucket support assembly 41 to substantially prevent any loss of the aforementioned collected coke spillage. A forward vertical shield plate 109 and a rear vertical shield plate 111 depend downwardly from the bottom of the coke guide cage 21 adjacent the opening 97. The forward and rear shield plates 109 and 111 form a substantially continuous bucket enclosure means with the forward and rear vertical shields 37 and 39 of the bucket assembly 41 through the buckets range of vertical travel. As a result of this preferred configuration, while the 'U'-shaped bucket 29 has integral side members 33 which inhibit coke spillage on either side of the bucket, spillage of coke at both the front and rear portions of the bucket is inhibited by the continuous closure means. Each vertical side member 99 of the coke guide 21 has a pair of guide rails 115 spaced to receive and guide the parallel arms 67 and 69 of the 'U'-shaped bucket 29 therebetween as the bucket is lifted into the raised position. The stirrup 103, the planar bottom member of the bucket 29 and the planar floor 95 of the coke guide 89 are now one basic level member presented to the oven floor to provide a path for the coke flow from the oven to the quenching receptacle. The coke spillage in the raised bucket is swept in front of the coke stream as it is pushed from the oven and through the coke guide. Upon completion of the pushing operation, the 'U'-shaped bucket 29 is withdrawn from the coke guide cage by being lowered from the second or raised position to the first or spillage catching position. The coke guide cage is then withdrawn from the oven to a stowed position. With the 'U'-shaped bucket now positioned as shown in FIG. 2, the selected oven is available for servicing by the door jamb cleaning device. Any breeze or coke dislodged during jamb cleaning is caught and collected in the 'U'-shaped bucket. The cleaned oven door is now returned to the oven and the servicing of the selected oven is complete. The bucket support assembly 41 is pivoted about the horizontal axis 43 from the position adjacent the oven face to a stowed position, distal therefrom and clear of the oven battery buckstay. The servicing car can now be spotted at the next oven to be serviced.

Figure 5:
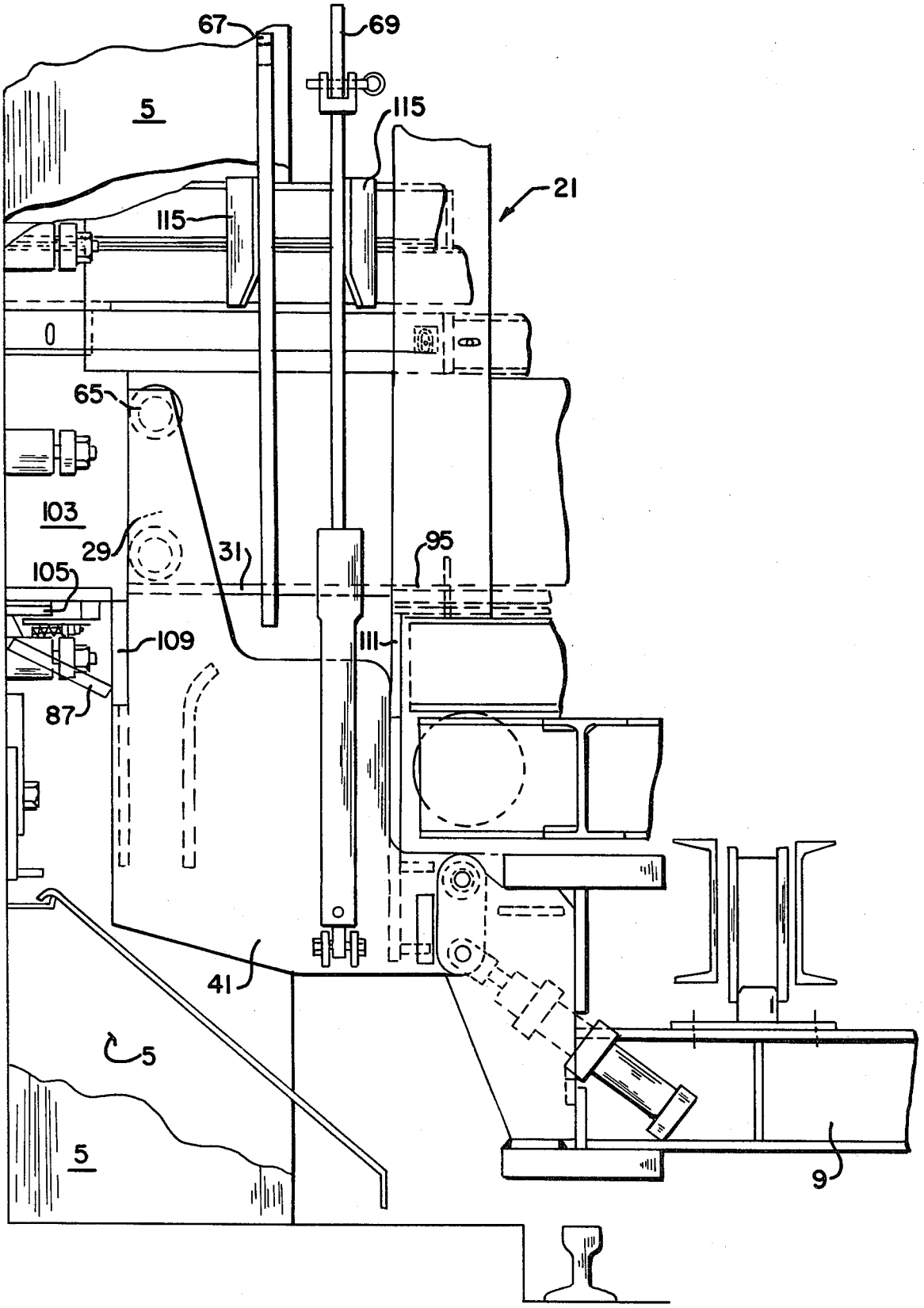
FIG. 5 is a side elevation of the coke side servicing apparatus of this invention positioned to convey pushed coke and spillage from the oven with portions of the oven battery and coke side servicing car cut away.
Figure 6:
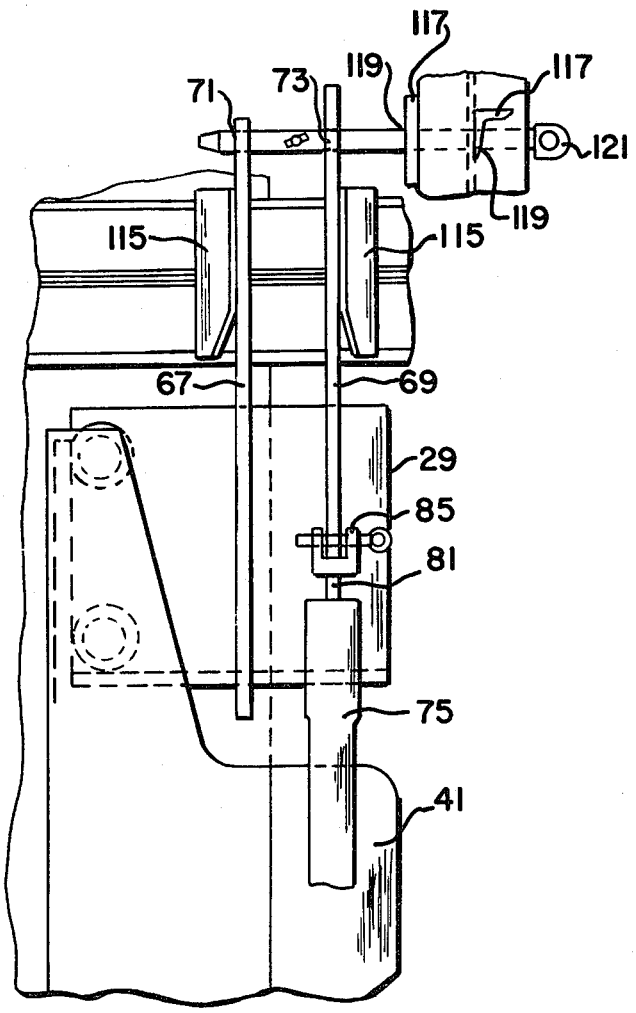
FIG. 6 is a side elevation view of the locking assembly provided in the apparatus of this invention for use in the event of an emergency or "sticker" condition during the push.

Considering FIGS. 5 and 6 a further feature of the present invention can be viewed. The side walls 99 of the coke guide are each provided with a pair of apertured suspension brackets 117. The apertures 119 of each bracket 117 are in axial alignment with the bores 71 and 73 of arms 67 and 69 respectively whenever the 'U' bucket 29 is in the raised position. In an emergency situation, such as a "sticker" condition on the push, the 'U'bucket 29, being in the raised operational position, integral with the coke guide, can be locked into the aforesaid position by the insertion of a self-locking pin 121 through the aligned apertures 119 and bores 71 and 73. The self-locking pin 85 is then withdrawn from the piston 81 and bracket 83 thus rendering the 'U' bucket 29 completely detached from the bucket support assembly 41. The coke guide cage 21, with the full load of hot coke therein can be withdrawn from the oven as necessary to obtain access to the oven and pusher arm. Once the 'sticker' condition is corrected the coke guide is repositioned over the bracket support assembly so that the piston 81 of cylinder 75 can be engaged with the arm 69 and self-locking pin 121 removed. The servicing apparatus is now returned to its normal operational status. The bucket 29 can also be locked to the coke guide cage 21 as described above in the event of a casualty to the bucket support assembly 41 so that oven pushing can continue while repairs are effected.

What has been described is a coke spillage removal device which can be incorporated into a variety of coke side servicing car designs during the manufacture of such cars or retro-fitted onto existing coke side servicing cars.

What is claimed is:

1. A coke oven battery servicing apparatus for catching and collecting coke discharged from the oven during door removal and conveying the collected discharged coke together with the coke pushed from the oven, from the face of the oven to a quenching receptacle, across a coke side servicing car disposed therebetween, comprising:

coke guide cage means having a first end and a second end and a generally horizontally disposed planar floor member extending therebetween, said planar floor member having an opening therein proximate said first end, said coke guide means being mounted on said servicing car for selective movement at least from a position in which said first end is spaced from the oven face for door removal to a position in which said first end is adjacent a selected oven; and coke catching means having a generally planar bottom member which is complementary to the opening in said coke guide floor member, said coke catching means being mounted on said servicing car for selective movement from at least a first position in which said coke catching means is disposed below and adjacent the selected oven during door removal to catch and collect discharged coke, to a second position in which said planar bottom member is removably inserted into the opening in said coke guide floor member and together with said floor member defines a generally continuous planar surface on which the discharged coke together with the coke remaining in the oven is conveyed to the quenching receptacle when said first end of said coke guide is adjacent the selected oven.

2. The coke oven battery servicing apparatus of claim 1 wherein the coke catching means is retractable from a position adjacent the selected oven to a stowed position clear of the selected oven.

3. The coke oven battery servicing apparatus of claim 2 wherein the coke catching means includes a support assembly in which said coke catching means is mounted for movement from the first position to the second position and wherein said support assembly is movably mounted on the servicing car, whereby said coke catching means is retracted from the oven to the stowed position by the movement of said support assembly.

4. The coke oven battery servicing apparatus of claim 3 wherein the coke catching means is a generally 'U'-shaped member having front and back open ends in axial alignment with the longitudinal axis of the selected oven, and wherein the coke guide means includes generally planar side members vertically disposed in a spaced relation between the first end and the second end of said coke guide means, said planar side members each having an opening therein contiguous with the opening in the planar floor member, such that said 'U'-shaped member is complementary to said openings in said side members and floor member whereby when said 'U'-shaped catching means is in the second position, said 'U'-shaped member is integral with said coke guide means.

5. The coke oven battery servicing apparatus of claim 4 wherein the 'U'-shaped coke catching means is removably mounted within the support assembly and said support assembly includes means to effect the movement of said 'U' shaped coke catching means from the first to the second position, said movement effecting means being disengagedly secured to said 'U'-shaped coke catching means whereby said 'U'-shaped coke catching means is completely detachable from said support assembly by the disengagement of said movement effecting means therefrom.

6. The coke oven battery servicing apparatus of claim 5 wherein the coke guide means includes means for selectively, removably securing the 'U'-shaped coke catching means thereto when said coke catching means is in the second position, integral with said coke guide means, such that the movement effecting means can be disengaged and said coke guide means moved relative to the oven face.

7. The coke oven battery servicing apparatus of claims 4 or 6 wherein the support assembly comprises a pair of generally parallel side members movably mounted to the servicing car and a front vertical shield member and a rear vertical shield member which together with the side members form a generally rectangular member in which the 'U'-shaped bucket is movably mounted, wherein the front and rear vertical shield members are contiguous with the open ends of said 'U'-shaped member and inhibit loss of collected coke from the 'U'-shaped member.

8. The coke oven battery servicing apparatus of claim 7 wherein the coke guide means includes a first depending vertical shield member forward of the opening in the floor member thereof and a second depending vertical shield member aft of the aforementioned opening such that when said coke guide means is adjacent the selected coke oven said first depending vertical shield is generally contiguous with the front vertical shield member of the support assembly and the second depending vertical shield is generally contiguous with the rear vertical shield member of the assembly whereby as the 'U'-shaped coke catching member is selectively moved from the first position to the second position the combined shields are contiguous with the open ends of said 'U'-shaped member and inhibit loss of collected coke therefrom throughout the range of vertical movements thereof.

9. The coke oven battery servicing apparatus of claim 7 wherein the generally parallel side members include vertically disposed rail means and wherein the 'U'-shaped coke catching member includes guide roller means which engage said rail means and facilitate the movement of said 'U'-shaped member from said first to said second position.

10. The coke oven battery servicing apparatus of claims 3, 4 or 6 wherein the support assembly is pivotally mounted on the servicing car.

11. An apparatus for servicing a coke oven battery comprising:

a servicing car mounted on wheels for movement parallel to one face of the coke oven battery;

coke oven door remover means mounted on said servicing car for reciprocal movement along its own longitudinal axis toward and away from a selected oven of the coke oven battery at least when in alignment therewith, and for reciprocal movement relative to the longitudinal axis of said servicing car which movement displaces said door remover means from its alignment with said selected oven;

coke guide means mounted on said servicing car for extension along its own longitudinal axis toward the selected oven to guide coke pushed from the selected oven across the servicing car and for reciprocal movement relative to the longitudinal axis of the servicing car when retracted from the selected oven;

means for sequentially aligning the door remover means and the coke guide means with the selected oven and for extending the selected means toward the oven; and, coke catching means mounted on said servicing car for selective movement between a first position in which said coke catching means is disposed below and adjacent said selected oven while both the door remover means and the coke guide means are aligned with and extended toward the selected oven and in which position the coke catching means catches coke spilled during door removal, a second position in which the coke catching means places the coke spilled during door removal into the coke guide means for removal with coke pushed from the selected oven and a third position in which the coke catching means is clear of the coke oven battery for movement of the servicing car parallel to the face of the coke oven battery.

12. The apparatus of claim 11 wherein the coke guide means comprises a first end and a second end, and a generally horizontally disposed planar floor member therebetween, said planar floor member having an opening therein proximate said first end and wherein the coke catching means comprises a generally planar bottom member which is complementary to the opening in said coke guide floor member, said coke catching means being movable from the first position adjacent and below the selected coke oven to said second position in which said generally planar bottom member is removably inserted into the opening in said planar floor member of said coke guide means and together therewith forms a generally continuous planar surface.

13. The apparatus of claim 12 wherein the coke catching means is a generally 'U'-shaped member having front and back open ends in axial alignment with the longitudinal axis of the selected oven and wherein the coke guide means includes generally planar side members vertically disposed in a spaced relation between the first end and the second end of said coke guide means, said planar side members each having an opening therein contiguous with the opening in the planar floor member, such that said 'U'-shaped member is complementary to said openings in said side members and floor member whereby when said 'U'-shaped catching means is in the second position, said 'U'-shaped member is integral with said coke guide means.

* * * * *